US007131308B2

(12) United States Patent
McCullough et al.

(10) Patent No.: US 7,131,308 B2
(45) Date of Patent: Nov. 7, 2006

(54) METHOD FOR MAKING METAL CLADDED METAL MATRIX COMPOSITE WIRE

(75) Inventors: Colin McCullough, Minneapolis, MN (US); Douglas E. Johnson, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 24 days.

(21) Appl. No.: 10/778,488

(22) Filed: Feb. 13, 2004

(65) Prior Publication Data

US 2005/0178000 A1 Aug. 18, 2005

(51) Int. Cl.
*B21C 23/22* (2006.01)

(52) U.S. Cl. ..... 72/258; 72/47; 72/262

(58) Field of Classification Search ..... 72/253.1, 72/256, 257, 258, 259, 262, 268, 46, 47; 427/117, 118; 428/378, 380, 381, 614
See application file for complete search history.

(56) References Cited

U.S. PATENT DOCUMENTS

| | | | | |
|---|---|---|---|---|
| 32,385 | A | 5/1861 | Smith | |
| 32,399 | A | 5/1861 | Hurlbut | |
| 3,429,722 | A | 2/1969 | Economy et al. | |
| 3,567,407 | A * | 3/1971 | Yoblin | 428/614 |
| 3,706,216 | A * | 12/1972 | Weingarten | 72/258 |
| 3,795,524 | A | 3/1974 | Sowman | |
| 4,047,965 | A | 9/1977 | Karst et al. | |
| 4,217,852 | A | 8/1980 | Nagai et al. | |
| 4,242,368 | A | 12/1980 | Nagai et al. | |
| 4,300,379 | A * | 11/1981 | Johnson et al. | 72/258 |
| 5,093,880 | A | 3/1992 | Matsuda et al. | |
| 5,171,942 | A | 12/1992 | Powers | |
| 5,335,527 | A | 8/1994 | Nagai et al. | |
| 5,501,906 | A | 3/1996 | Deve | |
| 5,554,826 | A | 9/1996 | Gentry | |
| 5,780,154 | A | 7/1998 | Okano et al. | |
| 5,822,484 | A | 10/1998 | Arroyo | |
| 6,003,356 | A * | 12/1999 | Mills et al. | 72/258 |
| 6,047,586 | A * | 4/2000 | Hannen | 72/262 |
| 6,180,232 | B1 | 1/2001 | McCullough et al. | |
| 6,245,425 | B1 | 6/2001 | McCullough et al. | |
| 6,329,056 | B1 | 12/2001 | Deve et al. | |
| 6,336,495 | B1 | 1/2002 | McCullough et al. | |
| 6,344,270 | B1 | 2/2002 | McCullough et al. | |
| 6,447,927 | B1 | 9/2002 | McCullough et al. | |
| 6,460,597 | B1 | 10/2002 | McCullough et al. | |
| 6,485,796 | B1 | 11/2002 | Carpenter et al. | |
| 6,544,645 | B1 | 4/2003 | McCullough et al. | |
| 6,559,385 | B1 | 5/2003 | Johnson et al. | |

(Continued)

FOREIGN PATENT DOCUMENTS

| | | |
|---|---|---|
| DE | 159611 | 3/1983 |

(Continued)

OTHER PUBLICATIONS

LITERATURE: "1995 The Electricity Society National Symposium—Mechanical Characteristics of SiC Fiber Reinforced Aluminum Composite Material", Ozawa et al., 2 pages, English translation.

(Continued)

*Primary Examiner*—Ed Tolan
(74) *Attorney, Agent, or Firm*—Gregory D. Allen

(57) ABSTRACT

A method for forming metal-cladded metal matrix composite wires. The method associates a ductile metal cladding to the exterior surface of a metal matrix composite wire comprising a plurality of continuous, longitudinally positioned fibers in a metal matrix.

39 Claims, 6 Drawing Sheets

U.S. PATENT DOCUMENTS

| | | | |
|---|---|---|---|
| 6,723,451 | B1 | 4/2004 | McCullough et al. |
| 6,779,589 | B1 | 8/2004 | Blucher et al. |
| 2003/0029902 | A1 | 2/2003 | Blucher |
| 2004/0026112 | A1 | 2/2004 | Goldsworthy et al. |

FOREIGN PATENT DOCUMENTS

| | | | |
|---|---|---|---|
| DE | 3403046 | | 3/1985 |
| EP | 0 172 563 | A2 | 2/1986 |
| EP | 0 202 953 | A2 | 11/1986 |
| EP | 0 598 953 | A1 | 6/1994 |
| GB | 910047 | | 11/1959 |
| GB | 1370894 | | 10/1974 |
| GB | 1584131 | | 2/1981 |
| GB | 2 177 948 | A | 2/1987 |
| GB | 2 274 795 | A | 8/1994 |
| GB | 2 326 121 | A | 12/1998 |
| HU | 9602005 | | 4/1998 |
| JP | 5-236274 | | 9/1977 |
| JP | 59-11366 | | 3/1984 |
| JP | 60-137520 | | 7/1985 |
| JP | 61-170502 | | 8/1986 |
| JP | 61-296607 | | 12/1986 |
| JP | 62-86606 | | 4/1987 |
| JP | 63-230220 | | 9/1988 |
| JP | 63-245811 | | 10/1988 |
| JP | 1-119606 | | 5/1989 |
| JP | 1-241323 | | 9/1989 |
| JP | 3-485 | | 1/1991 |
| JP | 3-71509 | | 3/1991 |
| JP | 3-74008 | | 3/1991 |
| JP | 3-129606 | | 6/1991 |
| JP | 3-55531 | | 8/1991 |
| JP | 4-44366 | | 7/1992 |
| JP | 5-23001 | | 3/1993 |
| JP | 05337537 | | 12/1993 |
| JP | 6-187851 | | 7/1994 |
| JP | 8-176701 | | 7/1994 |
| JP | 6-238523 | | 8/1994 |
| JP | 8-306246 | | 11/1996 |
| JP | 9-147646 | | 6/1997 |
| JP | 9-245527 | | 9/1997 |
| JP | 10-201066 | | 7/1998 |
| JP | 10-237673 | | 8/1998 |
| JP | 10-241459 | | 9/1998 |
| WO | WO 96/32211 | | 10/1996 |
| WO | WO 02/06550 | A1 | 1/2002 |
| WO | WO 03/091008 | A1 | 11/2003 |

OTHER PUBLICATIONS

LITERATURE: "1995 The Electricity Society Electronics and Energy Department Symposium—Development and Evaluation Characteristics of SiC Fiber Reinforced Aluminum Composite Wires for Transmission Line", 9 pages, English translation.

NASA Publication N96-17095, Tokarsky, et al., "Metal Clad Aramid Fibers for Aerospace Wire and Cable", National Aeronautics and Space Administration, Cleveland, OH, Lewis Research Center, Third NASA Workshop on Wiring for Space Applications, Jul. 18-19, 1995, pp. 197-210.

McCullough et al., "Metal-Cladded Metal Matrix Composite Wire", U.S. Appl. No. 10/779,438, filed Feb. 13, 2004.

Draht, Meisenbach, "Aluminum-Kabelmantel durch Strangpressen," Bamberg, Germany, vol. 46, No. 7/8, Jul. 1, 1995, p. 392.

Boissier, Rene, Dictionnaire Technique des Fabrications Mecaniques, Ed. Desforges, 1979, p. 79.

Lange, K., Umformtechnik—Handbuch fur Industrie und Wissenschaft—Band 1: Grundlagen, 2e Auflage, Springer Verlag, 1984; pp. 7-9.

Hatch, Kathryn L. Textile Science, West Publishing Company, St. Paul, Minnesota, 1st Edition, 1993, p. 90.

* cited by examiner

METHOD FOR MAKING METAL CLADDED METAL MATRIX COMPOSITE WIRE

BACKGROUND OF THE INVENTION

In general, metal matrix composites (MMCs) are known. MMCs typically include a metal matrix reinforced with fibers either particulates, whiskers, short fibers or long. Examples of metal matrix composites include aluminum matrix composite wires (e.g., silicon carbide, carbon, boron, or polycrystalline alpha alumina fibers embedded in an aluminum matrix), titanium matrix composite tapes (e.g., silicon carbide fibers embedded in a titanium matrix), and copper matrix composite tapes (e.g., silicon carbide or boron carbide fibers embedded in a copper matrix).

One use of metal matrix composite wire is as a reinforcing member in bare overhead electrical power transmission cables is of particular interest. One typical need for cables is driven by the need to increase the power transfer capacity of existing transmission infrastructure.

Desirable performance requirements for cables for overhead power transmission include corrosion resistance, environmental endurance (e.g., UV and moisture), resistance to loss of strength at elevated temperatures, creep resistance, as well as relatively high elastic modulus, low density, low coefficient of thermal expansion, high electrical conductivity, and/or high strength. Although overhead power transmission cables including aluminum matrix composite wires are known, for some applications there is a continuing desire, for example, for aluminum matrix composite wires having improved strain to failure values and/or size uniformity.

The availability of round wires having a more uniform diameter at different points along the length of the round wires is desirable for providing cable constructions with a more uniform diameter. Thus, there is a need for a substantially continuous metal matrix composite wire having a round cross-section and uniform diameter and methods for making such a substantially continuous metal matrix composite wire.

SUMMARY OF THE INVENTION

The present invention relates to a method for making metal (e.g., aluminum and alloys thereof) cladded metal (e.g., aluminum and alloys thereof) matrix composite wires. The method comprises hot working a ductile metal to associate the ductile metal with the exterior surface of a metal matrix composite wire. Embodiments of the present invention pertain to aluminum matrix composite wires having an exterior surface covered with a metal cladding. Metal-cladded metal matrix composites according to the present invention are formed as wires exhibiting desirable properties with respect to elastic modulus, density, coefficient of thermal expansion, electrical conductivity, strength strain to failure, roundness and/or plastic deformation.

In one aspect, the present invention provides a method of making a metal-cladded metal matrix composite wire by moving a metal matrix composite wire through a chamber; associating ductile metal with the exterior surface of the metal matrix composite wire within the chamber while the temperature in the chamber is held below the melting point of the ductile metal and the pressure in the chamber is sufficient to plasticize the ductile metal; and withdrawing the metal matrix composite wire with the associated ductile metal from the chamber under conditions that are effective to shape the associated ductile metal into metal cladding that covers the exterior surface of the metal matrix composite wire to provide the metal-cladded metal matrix composite wire.

In another aspect, the method of making a metal-cladded metal matrix composite wire of the present invention places ductile metal in association with the exterior surface of the metal matrix composite wire; and manipulates the associated ductile metal under conditions that are effective to shape the associated ductile metal into metal cladding covering the exterior surface of the metal matrix composite wire to provide the metal-cladded metal matrix composite wire that exhibits a roundness value of at least 0.95 (in some embodiments, at least 0.97, at least 0.98, or even at least at least 0.99) over a length of the metal-cladded metal matrix composite wire of at least 100 meters, in some embodiments, at least 200 meters, at least 300 meters, at least 400 meters, at least 500 meters, at least 600 meters, at least 700 meters, at least 800 meters, or even at least 900 meters.

As used herein, the following terms are defined as indicated, unless otherwise specified herein:

"Continuous fiber" means a fiber having a length that is relatively infinite when compared to the average fiber diameter. Typically, this means that the fiber has an aspect ratio (i.e., ratio of the length of the fiber to the average diameter of the fiber) of at least $1\times10^5$ (in some embodiments, at least $1\times10^6$, or even at least $1\times10^7$). Typically, such fibers have a length on the order of at least 50 meters, and may even have lengths on the order of kilometers or more.

"Longitudinally positioned" means that the fibers are oriented relative to the length of the wire in the same direction as the length of the wire.

"Roundness value," which is a measure of how closely the cross-sectional shape of a wire approximates the circumference of a circle, is defined by the mean of individual measured roundness values over a specified length of the wire, as described in the Examples, below.

"Roundness uniformity value," which is the coefficient of variation in the measured single roundness values over a specified length of the wire, is the ratio of the standard deviation of individual measured roundness values divided by the mean of the individual measured roundness values, as described in the Examples, below.

"Diameter uniformity value," which is the coefficient of variation in the average of the individual measured diameters of a wire over a specified length of the wire, is defined by the ratio of the standard deviation of the average of the measured individual diameters divided by the average of the measured individual diameters, as described in the Examples, below.

DETAILED DESCRIPTION

The present invention is a method of making metal-cladded composite wire and cable. In general, the metal-cladded metal matrix composite wires of the present invention are made by associating a ductile metal cladding to metal matrix composite wire(s). Although not wanting to be bound by theory, the methods provided by the present invention are believed to produce metal-cladded composite wires with significantly improved properties. At least one wire according to the present invention may be combined into a cable (e.g., an electric power transmission cable).

Figure 1:
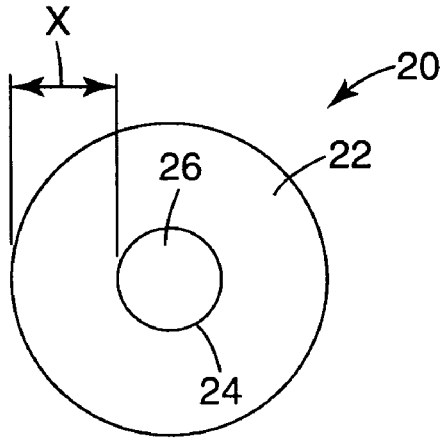
FIG. 1 is a schematic cross-sectional view of an exemplary metal-cladded metal matrix composite wire of the present invention.

A cross-sectional view of an exemplary metal-cladded fiber reinforced metal matrix composite wire 20 made according to the method of the present invention is provided in FIG. 1. The metal-cladded fiber reinforced metal matrix composite wire 20, hereinafter referred to as metal-cladded composite wire or MCCW, includes ductile metal cladding 22 associated with exterior surface 24 of a metal matrix composite wire 26. Metal matrix composite wire 26 may also be referred to as core wire 26. Ductile metal cladding 22 has an approximately annular shape with a thickness t. In some embodiments, metal matrix composite wire 26 is centered longitudinally within MCCW 20.

The method of the present invention associates cladding to metal matrix composite wires 26. Metal matrix composite wires 26 may be cladded to form metal-cladded composite wire (MCCW) 20 by utilizing the method described below and illustrated in FIGS. 2 and 3.

Figure 2:
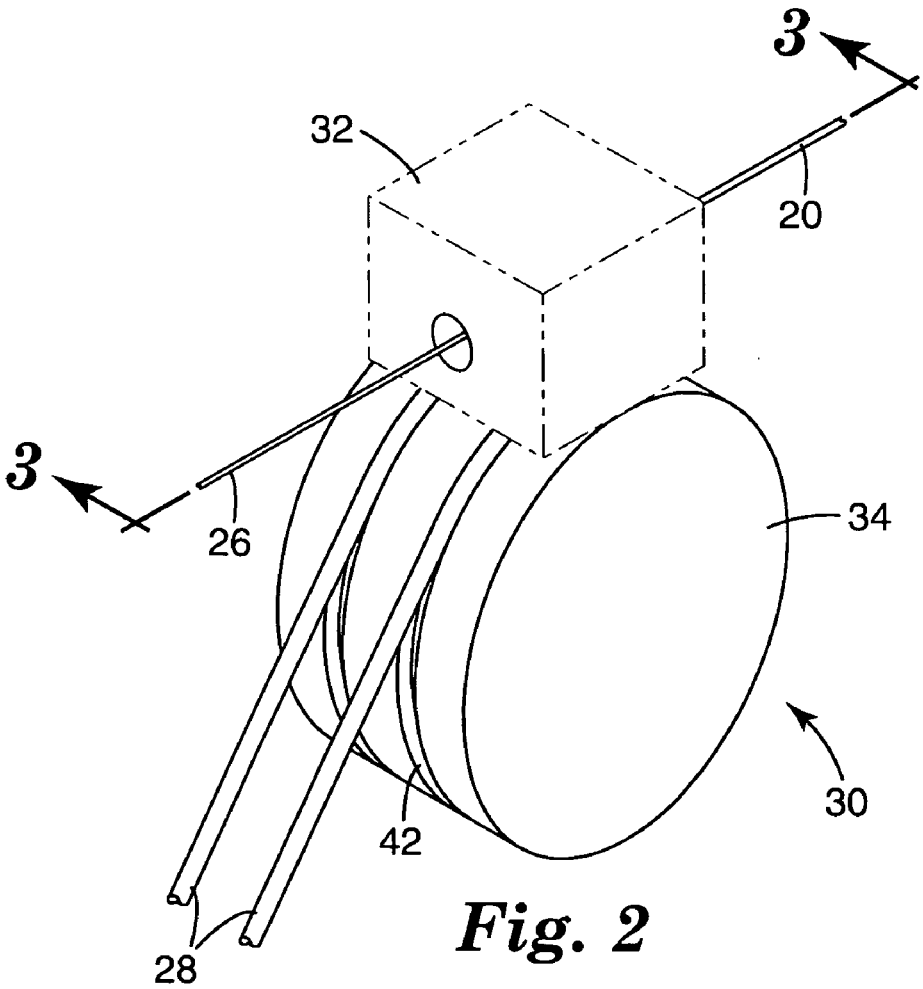
FIG. 2 is a perspective view of an exemplary twin groove cladding machine run in tangential mode for making metal-cladded metal matrix composite wire in accordance with the present invention.

Referring to FIG. 2, core wire 26 may be cladded with a ductile metal feedstock 28 to form MCCW 20 utilizing a cladding machine 30 (e.g. Model 350; available under the trade designation "CONKLAD" from BWE Ltd, in Ashford, England, UK). Cladding machine 30 comprises a shoe 32 above or adjacent to an extrusion wheel 34. Shoe 32 comprises a die chamber 36 (FIG. 3) accessed by an inlet guide die 38 on one end and an exit extrusion die 40 on the other. Extrusion wheel 34 comprises at least one peripheral groove 42, (typically two peripheral grooves) that feeds into die chamber 36.

In some embodiments, cladding machine 30 operates in a tangential mode. In tangential mode as illustrated in FIG. 2, the product centerline (i.e., MCCW 20) runs tangential to an extrusion wheel 34 of the cladding machine 30. This may be desirable since core wire 26 should not be run through any small radius bends sufficient to fracture the wire. Typically, the core wire 26 will follow a straight-line path.

Core wire 26 is supplied to cladding machine 30 on a spool (not shown) of sufficient diameter to prevent bending core wire 26 in excess of the wire's elastic limit. A pay off system with braking is used to control tension of core wire 26 at the spool. The tension of the core wire 26 is kept minimal to a level sufficient enough to prevent the spool of core wire 26 from uncoiling. Core wire 26 is typically not pre-heated prior to threading through the equipment, although it may be desirable in some embodiments. Optionally, core wire 26 may be cleaned prior to cladding using methods similar to those described below for feedstock 28.

Core wire 26 may be threaded through cladding machine 30 at shoe 32 above or adjacent to the extrusion wheel 34. Cross-sectional detail of shoe 32 is provided in FIG. 3. Shoe 32 contains an inlet guide die 38, die chamber 36 and an exit extrusion die 40. Core wire 26 passes directly through shoe 32 (i.e., extrusion tooling) by entering through inlet guide die 38, passing through die chamber 36 where cladding takes place, and exiting at exit extrusion die 40. Exit die 40 is larger than core wire 26, to accommodate the cladding thickness t. MCCW 20 is attached to a take-up drum (not shown) after exiting at the far side of shoe 32.

Prior to introduction into cladding machine 30, feedstock 28 for the ductile metal cladding is optionally cleaned to remove surface contamination. One suitable cleaning method is a parorbital cleaning system, available from BWE Ltd. This uses a mild alkaline cleaning solution (e.g. dilute aqueous sodium hydroxide), followed by an acid neutralizer (e.g. dilute acetic or other organic acid in an aqueous solution), and finally a water rinse. In the parorbital system, the cleaning fluid is hot and flows at high velocity along the wire, which is agitated in the fluid. Ultrasonic cleaning with chemical cleaning is also suitable.

Figure 3:
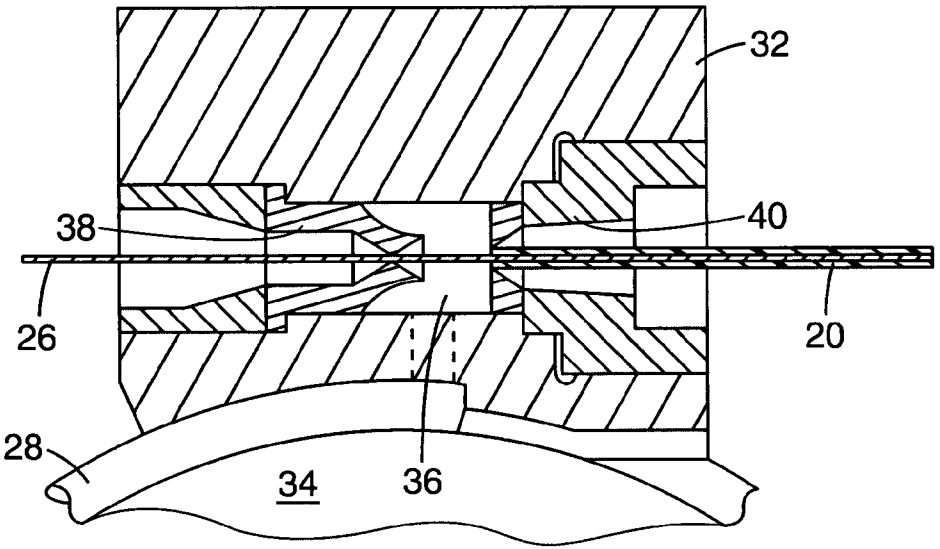
FIG. 3 is a schematic, cross-sectional view of an exemplary tooling die arrangement in a cladding machine for making metal-cladded metal matrix composite wire in accordance with the present invention.

The operation of cladding machine 30 is described as follows with reference to FIGS. 2 and 3, and is typically run as a continuous process. First, core wire 26 may be threaded through cladding machine 30, as described above. Feedstock 28 is introduced, in some embodiments as two rods, to a rotating extrusion wheel 34, which in some embodiments contains twin grooves 42 around the periphery. Each groove 42 receives a rod of feedstock 28.

Extrusion wheel 34 rotates, thereby forcing feedstock 28 into die chamber 36. The action of extrusion wheel 34 supplies sufficient pressure, in combination with the heat of die chamber 36, to plasticize feedstock 28. The temperature of the feedstock material within the die chamber 36 is typically below the melting temperature of the material. The material is hot worked such that it is plastically deformed at a temperature and strain rate that allows recrystallization to take place during deformation. By maintaining the feedstock material temperature below the melting point, cladding 22 formed from feedstock 28 has greater hardness than if the feedstock 28 had been applied in a melted form. For example, a temperature of approximately 500° C. is typical for aluminum feedstock with a melting point of approximately 660° C.

Feedstock 28 enters die chamber 36 on two sides of core wire 26 to help equalize the pressure and flow of feedstock 28 around core wire 26. The action of extrusion wheel 34 fills die chamber 36 with plasticized feedstock 28 due to re-direction and deformation of feedstock 28 by shoe 32. Cladding machine 30 has typical operating pressures within shoe 32 in the range of 14–40 kg/mm$^2$. For successful cladding of core wire 26, the pressure inside of shoe 32 will typically be towards the lower end of the operating range and is customized during operation by adjusting the speed of extrusion wheel 34. The speed of wheel 34 is adjusted until a condition is reached in die chamber 36 such that plasticized feedstock 28 extrudes out of exit die 40 around the core wire 26, without reaching pressures where damage to the core wire 26 is likely to occur. (If the wheel speed is too low, the feedstock does not extrude from exit die 40 or feedstock 28 extruded from exit die 40 does not pull core wire 26 out through exit die 40. If the wheel speed is too high, core wire 26 is sheared and cut.)

In addition, the temperature and pressure in the die chamber 36 are typically controlled to allow bonding of the cladding material (plasticized feedstock 28) to core wire 26, while also being sufficiently low to prevent damage to the more fragile core wire 26. It is also advantageous to balance the pressure of the feedstock 28 entering the die chamber 36 so as to center the core wire 26 within the plasticized feedstock 28. By centering the core wire 26 within the die chamber 36, the plasticized feedstock 28 forms a concentric annulus about the core wire 26.

An example of the line speed of MCCW 20 exiting cladding machine 30 is approximately 50 m/min. Tension is not needed and typically not supplied by the take-up drum collecting the product (i.e., MCCW 20) as the extruded feedstock 28 pulls the core wire 26 along with it through the cladding machine 30. After exiting the machine, MCCW 20 is passed through troughs (not shown) of water to cool it, and then is wound on a take-up drum.

Cladding Materials

Metal cladding 22 may be composed of any metal or metal alloy that exhibits ductility. In some embodiments, the metal cladding 22 is selected of a ductile metal material, including metal alloys, that does not significantly react chemically with material components (i.e., fiber and matrix material) of core wire 26.

Exemplary ductile metal materials for metal cladding 22 include aluminum, zinc, tin, magnesium, copper, and alloys thereof (e.g., an alloy of aluminum and copper). In some embodiments, the metal cladding 22 includes aluminum and alloys thereof. For aluminum cladding materials, in some embodiments, cladding 22 comprises at least 99.5 percent by weight aluminum. In some embodiments, useful alloys are 1000, 2000, 3000, 4000, 5000, 6000, 7000, and 8000 series aluminum alloys (Aluminum Association designations). Suitable metals are commercially available. For example, aluminum and aluminum alloys are available, for example, from Alcoa of Pittsburgh, Pa. Zinc and tin are available, for example, from Metal Services, St. Paul, Minn. ("pure zinc"; 99.999% purity and "pure tin"; 99.95% purity). For example, magnesium is available under the trade designation "PURE" from Magnesium Elektron, Manchester, England. Magnesium alloys (e.g., WE43A, EZ33A, AZ81A, and ZE41A) can be obtained, for example, from TIMET, Denver, Colo. Copper and alloys thereof are available from South Wire of Carrollton, Ga.

MCCW 20 may be formed on a core wire 26 which often includes at least one tow comprising a plurality of continuous, longitudinally positioned, fibers, such as ceramic (e.g., alumina based) reinforcing fibers encapsulated within a matrix that includes one or more metals (e.g., highly pure, (e.g., greater than 99.95%) elemental aluminum or alloys of pure aluminum with other elements, such as copper). In some embodiments, at least 85% (in some embodiments, at least 90%, or even at least 95%) by number of the fibers in the metal matrix composite wire 26 are continuous. Fiber and matrix selection for metal matrix composite wire 26 suitable for use in MCCW 20 of the present invention are described below.

Fibers

Continuous fibers for making metal matrix composite articles 26 suitable for use in MCCW 20 of the present invention include ceramic fibers, such as metal oxide (e.g., alumina) fibers, boron fibers, boron nitride fibers, carbon fibers, silicon carbide fibers, and combination of any of these fibers. Typically, the ceramic oxide fibers are crystalline ceramics and/or a mixture of crystalline ceramic and glass (i.e., a fiber may contain both crystalline ceramic and glass phases). Typically, this means that the fiber has an aspect ratio (i.e., ratio of the length of the fiber to the average diameter of the fiber) of at least $1\times10^5$ (in some embodiments, at least $1\times10^6$, or, even at least $1\times10^7$). Typically, such fibers have a length on the order of at least 50 meters, and may even have lengths on the order of kilometers or more. Typically, the continuous reinforcing fibers have an average fiber diameter of at least 5 micrometers to approximately an average fiber diameter no greater than 50 micrometers. More typically, an average fiber diameter is no greater than 25 micrometers, most typically in a range from 8 micrometers to 20 micrometers.

In some embodiments, the ceramic fibers have an average tensile strength of at least 1.4 GPa, at least 1.7 GPa, at least 2.1 GPa, and or even at least 2.8 GPa. In some embodiments, the carbon fibers have an average tensile strength of at least 1.4 GPa, at least 2.1 GPa, at least 3.5 GPa, or even at least 5.5 GPa. In some embodiments, the ceramic fibers have a modulus greater than 70 GPa to approximately no greater than 1000 GPa, or even no greater than 420 GPa. Methods of testing tensile strength and modulus are given in the examples.

In some embodiments, at least a portion of the continuous fibers used to make core wire 26 are in tows. Tows are known in the fiber art and refer to a plurality of (individual) fibers (typically at least 100 fibers, more typically at least 400 fibers) collected in a roving-like form. In some embodiments, tows comprise at least 780 individual fibers per tow, and in some cases, at least 2600 individual fibers per tow. Tows of ceramic fibers are available in a variety of lengths, including 300 meters, 500 meters, 750 meters, 1000 meters, 1500 meters, 1750 meters, and longer. The fibers may have a cross-sectional shape that is circular or elliptical.

Alumina fibers are described, for example, in U.S. Pat. No. 4,954,462 (Wood et al.) and U.S. Pat. No. 5,185,299 (Wood et al.). In some embodiments, the alumina fibers are polycrystalline alpha alumina fibers and comprise, on a theoretical oxide basis, greater than 99 percent by weight $Al_2O_3$ and 0.2–0.5 percent by weight $SiO_2$, based on the total weight of the alumina fibers. In another aspect, some desirable polycrystalline, alpha alumina fibers comprise alpha alumina having an average grain size of less than 1 micrometer (or even, in some embodiments, less than 0.5 micrometer). In another aspect, in some embodiments, polycrystalline, alpha alumina fibers have an average tensile strength of at least 1.6 GPa (in some embodiments, at least 2.1 GPa, or even, at least 2.8 GPa). Exemplary alpha alumina fibers are marketed under the trade designation "NEXTEL 610" by 3M Company, St. Paul, Minn.

Aluminosilicate fibers are described, for example, in U.S. Pat. No. 4,047,965 (Karst et al). Exemplary aluminosilicate fibers are marketed under the trade designations "NEXTEL 440", "NEXTEL 550", and "NEXTEL 720" by 3M Company of St. Paul, Minn.

Aluminoborosilicate fibers are described, for example, in U.S. Pat. No. 3,795,524 (Sowman). Exemplary aluminoborosilicate fibers are marketed under the trade designation "NEXTEL 312" by 3M Company.

Exemplary boron fibers are commercially available, for example, from Textron Specialty Fibers, Inc. of Lowell, Mass.

Boron nitride fibers can be made, for example, as described in U.S. Pat. No. 3,429,722 (Economy) and U.S. Pat. No. 5,780,154 (Okano et al.).

Exemplary silicon carbide fibers are marketed, for example, by COI Ceramics of San Diego, Calif. under the trade designation "NICALON" in tows of 500 fibers, from Ube Industries of Japan, under the trade designation "TYRANNO", and from Dow Corning of Midland, Mich. under the trade designation "SYLRAMIC".

Exemplary carbon fibers are marketed, for example, by Amoco Chemicals of Alpharetta, Ga. under the trade designation "THORNEL CARBON" in tows of 2000, 4000, 5,000, and 12,000 fibers, Hexcel Corporation of Stamford, Conn., from Grafil, Inc. of Sacramento, Calif. (subsidiary of Mitsubishi Rayon Co.) under the trade designation "PYROFIL", Toray of Tokyo, Japan, under the trade designation "TORAYCA", Toho Rayon of Japan, Ltd. under the trade designation "BESFIGHT", Zoltek Corporation of St. Louis, Mo. under the trade designations "PANEX" and "PYRON", and Inco Special Products of Wyckoff, N.J. (nickel coated carbon fibers), under the trade designations "12K20" and "12K50".

Exemplary graphite fibers are marketed, for example, by BP Amoco of Alpharetta, Ga. under the trade designation "T-300" in tows of 1000, 3000, and 6000 fibers.

Exemplary silicon carbide fibers are marketed, for example, by COI Ceramics of San Diego, Calif. under the trade designation "NICALON" in tows of 500 fibers, from Ube Industries of Japan, under the trade designation "TYRANNO", and from Dow Corning of Midland, Mich. under the trade designation "SYLRAMIC".

Commercially available fibers typically include an organic sizing material added to the fiber during manufacture to provide lubricity and to protect the fiber strands during handling. The sizing may be removed, for example, by dissolving or burning the sizing away from the fibers. Typically, it is desirable to remove the sizing before forming metal matrix composite wire 26.

The fibers may have coatings used, for example, to enhance the wettability of the fibers, to reduce or prevent reaction between the fibers and molten metal matrix material. Such coatings and techniques for providing such coatings are known in the fiber and metal matrix composite art.

Matrix

Typically, the metal matrix of the metal matrix composite wire 26 is selected such that the matrix material does not significantly react chemically with the fiber material (i.e., is relatively chemically inert with respect to fiber material), for example, to eliminate the need to provide a protective coating on the fiber exterior. The metal selected for the matrix material need not be the same material as that of the cladding 22, but should not significantly react chemically with the cladding 22. Exemplary metal matrix materials include aluminum, zinc, tin, magnesium, copper, and alloys thereof (e.g., an alloy of aluminum and copper). In some embodiments, the matrix material desirably includes aluminum and alloys thereof.

In some embodiments, the metal matrix comprises at least 98 percent by weight aluminum, at least 99 percent by weight aluminum, greater than 99.9 percent by weight aluminum, or even greater than 99.95 percent by weight aluminum. Exemplary aluminum alloys of aluminum and copper comprise at least 98 percent by weight Al and up to 2 percent by weight Cu. In some embodiments, useful alloys are 1000, 2000, 3000, 4000, 5000, 6000, 7000 and/or 8000 series aluminum alloys (Aluminum Association designations). Although higher purity metals tend to be desirable for making higher tensile strength wires, less pure forms of metals are also useful.

Suitable metals are commercially available. For example, aluminum is available under the trade designation "SUPER PURE ALUMINUM; 99.99% Al" from Alcoa of Pittsburgh, Pa. Aluminum alloys (e.g., Al-2% by weight Cu (0.03% by weight impurities)) can be obtained, for example, from Belmont Metals, New York, N.Y. Zinc and tin are available, for example, from Metal Services, St. Paul, Minn. ("pure zinc"; 99.999% purity and "pure tin"; 99.95% purity). For example, magnesium is available under the trade designation "PURE" from Magnesium Elektron, Manchester, England. Magnesium alloys (e.g., WE43A, EZ33A, AZ81A, and ZE41A) can be obtained, for example, from TIMET, Denver, Colo.

Metal matrix composite wires 26 suitable for the MCCW 20 of the present invention include those comprising at least 15 percent by volume (in some embodiments, at least 20, 25, 30, 35, 40, 45, or even 50 percent by volume) of the fibers, based on the total combined volume of the fibers and matrix material. Typically, core wire 26 for use in the method of the present invention comprise in the range from 40 to 70 (in some embodiments, 45 to 65) percent by volume of the fibers, based on the total combined volume of the fibers and matrix material (i.e., independent of cladding).

The average diameter of core wire 26 is typically between approximately 0.07 millimeter (0.003 inch) to approximately 3.3 mm (0.13 inch). In some embodiments, the average diameter of core wire 26 desirable is at least 1 mm, at least 1.5 mm, or even up to approximately 2.0 mm (0.08 inch).

Making Core Wire

Typically, the continuous core wire 26 can be made, for example, by continuous metal matrix infiltration processes. One suitable process is described, for example, in U.S. Pat. No. 6,485,796 (Carpenter et al.), the disclosure of which is incorporated herein by reference.

Figure 4:
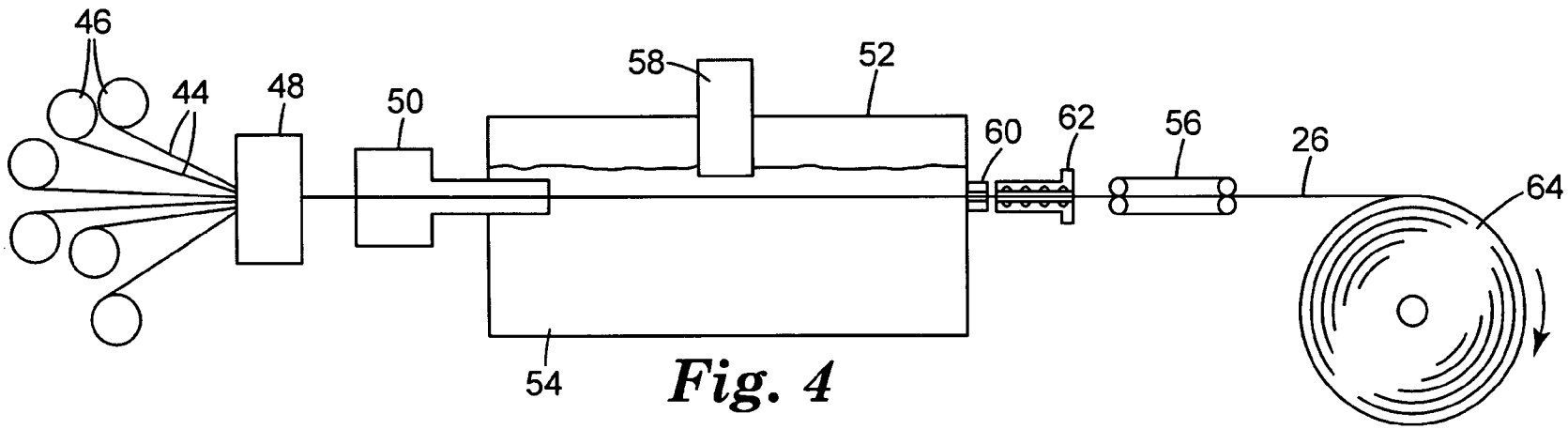
FIG. 4 is a schematic view of an exemplary ultrasonic apparatus used to infiltrate fibers with molten metals in accordance with the present invention.

A schematic of an exemplary apparatus for making continuous metal matrix wire 26 for use in MCCW 20 of the present invention is shown in FIG. 4. Tows of continuous ceramic and/or carbon fibers 44 are supplied from supply spools 46, and are collimated into a circular bundle and for ceramic fibers, heat-cleaned while passing through tube furnace 48. The fibers 44 are then evacuated in vacuum chamber 50 before entering crucible 52 containing the melt 54 of metallic matrix material (also referred to herein as "molten metal"). The fibers are pulled from supply spools 46 by caterpuller 56. Ultrasonic probe 58 is positioned in the melt 54 in the vicinity of the fiber to aid in infiltrating the melt 54 into tows 44. The molten metal of the wire 26 cools and solidifies after exiting crucible 52 through exit die 60, although some cooling may occur before the wire 26 fully exits crucible 52. Cooling of wire 26 is enhanced by streams of gas or liquid from device 62 that impinge on the wire 26. Wire 26 is collected onto spool 64.

As discussed above, heat-cleaning the ceramic fiber helps remove or reduce the amount of sizing, adsorbed water, and other fugitive or volatile materials that may be present on the surface of the fibers. Typically, it is desirable to heat-clean the ceramic fibers until the carbon content on the surface of the fiber is less than 22% area fraction. Typically, the temperature of the tube furnace 54 is at least 300° C., more typically, at least 1000° C. for at least several seconds at temperature, although the particular temperature(s) and time(s) may depend, for example, on the cleaning needs of the particular fiber being used.

In some embodiments, the fibers 44 are evacuated before entering the melt 54, as it has been observed that use of such evacuation tends to reduce or eliminate the formation of defects, such as localized regions with dry fibers (i.e., fiber regions without infiltration of the matrix). Typically, fibers 44 are evacuated in a vacuum of in some embodiments not greater than 20 torr, not greater than 10 torr, not greater than 1 torr, or even not greater than 0.7 torr.

An exemplary suitable vacuum system 50 is an entrance tube sized to match the diameter of the bundle of fiber 44. The entrance tube can be, for example, a stainless steel or alumina tube, and is typically at least 30 cm long. A suitable vacuum chamber 50 typically has a diameter in the range from 2 cm to 20 cm, and a length in the range from 5 cm to 100 cm. The capacity of the vacuum pump is, in some embodiments, at least 0.2–0.4 cubic meters/minute. The evacuated fibers 44 are inserted into the melt 54 through a tube on the vacuum system 50 that penetrates the metal bath (i.e., the evacuated fibers 44 are under vacuum when introduced into the melt 54), although the melt 54 is typically at atmospheric pressure. The inside diameter of the exit tube essentially matches the diameter of the fiber bundle 44. A portion of the exit tube is immersed in the molten metal. In some embodiments, 0.5–5 cm of the tube is immersed in the molten metal. The tube is selected to be stable in the molten metal material. Examples of tubes which are typically suitable include silicon nitride and alumina tubes.

Infiltration of the molten metal 54 into the fibers 44 is typically enhanced by the use of ultrasonics. For example, a vibrating horn 58 is positioned in the molten metal 54 such that it is in close proximity to the fibers 44. In some embodiments, the fibers 44 are within 2.5 mm (in some embodiments within 1.5 mm) of the horn tip. The horn tip is, in some embodiments, made of niobium, or alloys of niobium, such as 95 wt. % Nb-5 wt. % Mo and 91 wt. % Nb-9 wt. % Mo, and can be obtained, for example, from PMTI, Pittsburgh, Pa. For additional details regarding the use of ultrasonics for making metal matrix composite articles, see, for example, U.S. Pat. No. 4,649,060 (Ishikawa et al.), U.S. Pat. No. 4,779,563 (Ishikawa et al.), and U.S. Pat. No. 4,877,643 (Ishikawa et al.), U.S. Pat. No. 6,180,232 (McCullough et al.), U.S. Pat. No. 6,245,425 (McCullough et al.), U.S. Pat. No. 6,336,495 (McCullough et al.), U.S. Pat. No. 6,329,056 (Deve et al.), U.S. Pat. No. 6,344,270 (McCullough et al.), U.S. Pat. No. 6,447,927 (McCullough et al.), and U.S. Pat. No. 6,460,597 (McCullough et al.), U.S. Pat. No. 6,485,796 (Carpenter et al.), U.S. Pat. No. 6,544,645 (McCullough et al.); U.S. application having Ser. No. 09/616,741, filed Jul. 14, 2000; and PCT application having Publication No. WO02/06550, published Jan. 24, 2002.

Typically, the molten metal 54 is degassed (e.g., reducing the amount of gas (e.g., hydrogen) dissolved in the molten metal 54) during and/or prior to infiltration. Techniques for degassing molten metal 54 are well known in the metal processing art. Degassing the melt 54 tends to reduce gas porosity in the wire. For molten aluminum, the hydrogen concentration of the melt 54 is in some embodiments, less than 0.2, 0.15, or even less than 0.1 $cm^3$/100 grams of aluminum.

The exit die 60 is configured to provide the desired wire diameter. Typically, it is desired to have a uniformly round wire along its length. The diameter of the exit die 60 is usually slightly smaller than the diameter of the wire 26. For example, the diameter of a silicon nitride exit die for an aluminum composite wire containing 50 volume percent alumina fibers is 3 percent smaller than the diameter of the wire 26. In some embodiments, the exit die 60 is desirably made of silicon nitride, although other materials may also be useful. Other materials that have been used as exit dies in the art include conventional alumina. It has been found by Applicants, however, that silicon nitride exit dies wear significantly less than conventional alumina dies, and hence are more useful for providing the desired diameter and shape of the wire, particularly over long lengths of wire.

Typically, the wire 26 is cooled after exiting the exit die 60 by contacting the wire 26 with a liquid (e.g., water) or gas (e.g., nitrogen, argon, or air) from device 62. Such cooling aids in providing the desirable roundness and uniformity characteristics, and freedom from voids. Wire 26 is collected on spool 64.

It is known that the presence of imperfections in the metal matrix composite wire, such as intermetallic phases; dry fiber; porosity as a result, for example, of shrinkage or internal gas (e.g., hydrogen or water vapor) voids; etc. may lead to diminished properties, such as wire 20 strength. Hence, it is desirable to reduce or minimize the presence of such characteristics.

Metal-cladded Metal Matrix Composite Wire (MCCW)

The cladding method of the present invention produces exemplary metal-cladded metal matrix composite wire 20 that exhibits improved properties as compared to the unclad wire 26. For core wire 26 with a generally circular cross-sectional shape, the cross-sectional shape of the resulting wire is typically not a perfect circle. The cladding method of the present invention compensates for irregularly shaped core wire 26 to create a relatively circular metal-cladded product (i.e., MCCW 20). The thickness t of cladding 22 may vary to compensate for inconsistencies in the shape of core wire 26 and the method centers core wire 26, thereby improving the specifications and tolerances, such as diameter and roundness of MCCW 20. In some embodiments, the average diameter of MCCW 20 with a generally circular cross-sectional shape according to the present invention is at least 1 mm, at least 1.5 mm, 2 mm, 2.5 mm, 3 mm, or even 3.5 mm.

The ratio of the minimum and maximum diameter of MCCW 20 (See Roundness Value Test, wherein for a perfectly round wire would have a value of 1) typically is at least 0.9, in some embodiments, at least 0.92, at least 0.95, at least 0.97, at least 0.98, or even at least 0.99 over a length of MCCW 20 of at least 100 meters. The roundness uniformity (See Roundness Uniformity Test, below) is typically not greater than not greater than 0.9%, in some embodiments, not greater than 0.5% and not greater than 0.3% over a length of MCCW 20 of at least 100 meters. The diameter uniformity (See Diameter Uniformity Test, below) is typically not greater than 0.2% over a length of MCCW 20 of at least 100 meters.

MCCW 20 produced by the method of the present invention desirably resist secondary failure modes, such as micro-buckling and general buckling, when primary failure occurs in tension applications. Metal cladding 22 of MCCW 20 acts to prevent rapid recoil of the metal matrix composite wire 26 and suppresses the compressive shock wave that causes secondary fractures during or following primary failure.

Metal cladding 22 plastically deforms and dampens the rapid recoil of wire core 26. Where MCCW 20 is desired to exhibit suppression of secondary fractures, metal cladding 22 will desirably have sufficient thickness t to absorb and suppress the compressive shock wave. For core wire 26 with an approximate diameter between 0.07 mm to 3.3 mm, the cladding thickness t will desirably be in the range from 0.2 mm to 6 mm, or more desirably in the range from 0.5 mm to 3 mm. For example, metal cladding 22 with an approximate wall thickness t of approximately 0.7 mm is suitable for an aluminum composite wire 26 with a nominal 2.1 mm diameter, thereby forming a MCCW 20 with an approximate diameter of 3.5 mm (0.14 inch).

MCCW 20 produced according to the present invention also desirably exhibits the ability to be plastically deformed. Conventional metal matrix composite wires typically exhibit elastic bending modes and do not exhibit plastic deformation without also experiencing material failure. Beneficially, MCCW 20 of the present invention retains an amount of bend (i.e., plastic deformation) when bent and subsequently released. The ability to be plastically deformed is useful in applications where a plurality of wires is to be stranded or coiled into a cable. MCCW 20 may be cabled and will retain the bent structure without requiring additional retention means such as tape or adhesives. Where MCCW 20 is desired to take a permanent set (i.e., plastically deform), cladding 22 will have a thickness t sufficient to counter the return force of core wire 26 to an initial (unbent) state. For core wire 26 with an approximate diameter between 0.07 mm to 3.3 mm, the cladding thickness t will desirably be in the range from 0.5 mm to approximately 3 mm. For example, a metal cladding with an approximate wall thickness of approximately 0.7 mm is suitable for an aluminum composite wire 26 with a nominal 2.1 mm diameter, thereby forming a MCCW 20 with an approximate diameter of 3.5 mm (0.14 inch).

MCCW 20 made according to the methods of the present invention have a length, of at least 100 meters, of at least 200 meters, of at least 300 meters, at least 400 meters, at least 500 meters, at least 600 meters, at least 700 meters, at least 800 meters, or even at least 900 meters.

Cables of Metal-cladded Metal Matrix Composite Wire

Metal-cladded metal matrix composite wires made according to the present invention can be used in a variety of applications including in overhead electrical power transmission cables.

Figure 5:
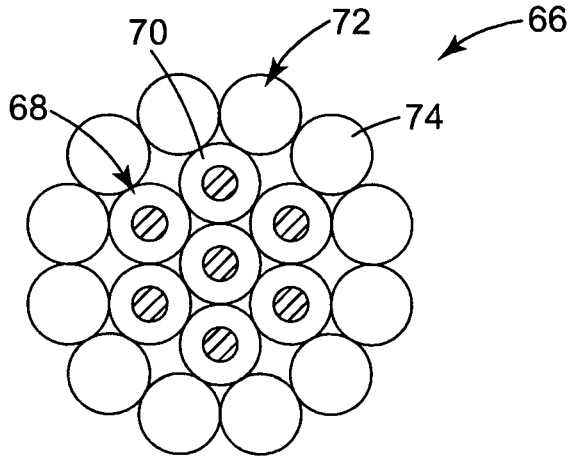
FIGS. 5 and 6 are schematic, cross-sectional views of two exemplary embodiments of overhead electrical power transmission cables comprising metal-cladded metal matrix composite wires in accordance with the present invention.
Figure 6:
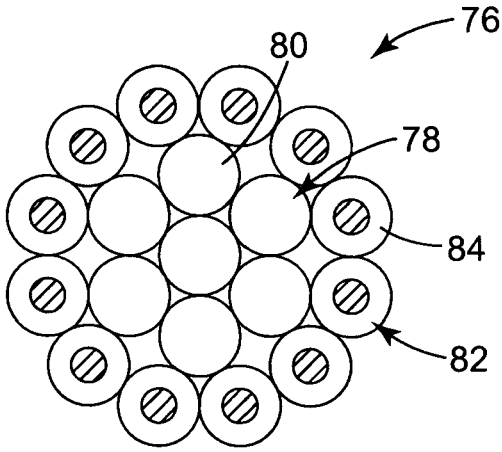
Figure 7:
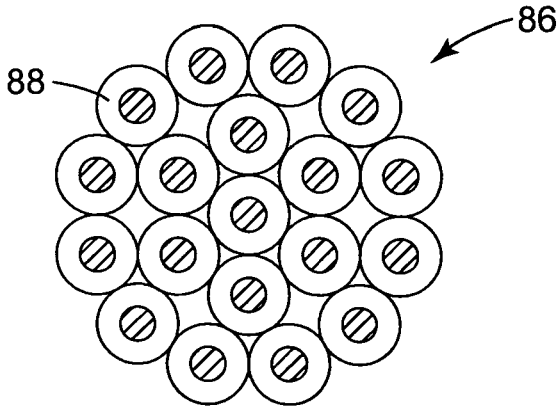
FIG. 7 is a schematic, cross-sectional view of a homogeneous cable comprising metal-cladded metal matrix composite wires made in accordance with the present invention.

Cables comprising metal-cladded metal matrix composite wires made according to the present invention may be homogeneous (i.e., including only wires such as MCCW 20) as in FIG. 7, or nonhomogeneous (i.e., including a plurality of secondary wires, such as metal wires) such as in FIGS. 5 and 6. As an example of a nonhomogeneous cable, the cable core can include a plurality of metal-cladded and metal matrix composite wires made according to the present invention with a shell that includes a plurality of secondary wires (e.g., aluminum wires), for example as shown in FIG. 5.

Cables comprising metal-cladded metal matrix composite wires made according to the present invention can be stranded. A stranded cable typically includes a central wire and a first layer of wires helically stranded around the central wire. In general, cable stranding is a process in which individual strands of wire are combined in a helical arrangement to produce a finished cable (see, e.g., U.S. Pat. No. 5,171,942 (Powers) and U.S. Pat. No. 5,554,826 (Gentry)). The resulting helically stranded wire rope provides far greater flexibility than would be available from a solid rod of equivalent cross sectional area. The helical arrangement is also beneficial because the stranded cable maintains its overall round cross-sectional shape when the cable is subject to bending in handling, installation and use. Helically wound cables may include as few as 3 individual strands to more common constructions containing 50 or more strands.

One exemplary cable comprising metal-cladded metal matrix composite wires made according to the present invention is shown in FIG. 5, where the cable 66 may be a cable core 68 of comprising a plurality of individual metal-cladded composite metal matrix wires 70 surrounded by a jacket 72 of a plurality of individual aluminum or aluminum alloy wires 74. Any suitable number of metal-cladded metal matrix composite wires 70 may be included in any layer. In addition, wire types (e.g., metal-cladded metal matrix composite wires and metal wires) may be mixed within any layer or cable. Furthermore, more than two layers may be included in the stranded cable 66 if desired. One of many alternatives, cable 76, as shown in FIG. 6, may be a cable core 78 of a plurality of individual metal wires 80 surrounded by jacket 82 of multiple individual metal-cladded metal matrix composite wires 84. Individual cables may be combined into wire rope constructions, such as a wire rope comprising 7 cables that are stranded together.

FIG. 7 illustrates another embodiment of a stranded cable according to the present invention 86. In this embodiment, the stranded cable is homogeneous, such that all wires in the cable are metal-cladded metal matrix composite wires made according to the present invention 88. Any suitable number of metal-cladded metal matrix composite wires 88 may be included.

Cables comprising metal-cladded metal matrix composite wires made according to the present invention can be used as a bare cable or it can be used as the cable core of a larger diameter cable. Also, cables comprising metal-cladded metal matrix composite wires according to the present invention may be a stranded cable of a plurality of wires with a maintaining means around the plurality of wires. The maintaining means may be, for example, a tape overwrap, with or without adhesive, or a binder.

Stranded cables comprising metal-cladded metal matrix composite wires according to the present invention are useful in numerous applications. Such stranded cables are believed to be particularly desirable for use in overhead electrical power transmission cables due to their combination of relatively low weight, high strength, good electrical conductivity, low coefficient of thermal expansion, high use temperatures, and resistance to corrosion.

Additional details regarding cladded metal matrix composite wires may be found, for example, in copending application having U.S. Ser. No. 10/779438, filed Feb. 13, 2004, the disclosure of which is incorporated herein by reference. Advantages and embodiments of this invention are further illustrated by the following examples, but the particular materials and amounts thereof recited in these examples, as well as other conditions and details, should not be construed to unduly limit this invention. All parts and percentages are by weight unless otherwise indicated.

EXAMPLES

Test Methods

Wire Tensile Strength

Tensile properties of MCCW 20 were determined essentially as described in ASTM E345-93, using a tensile tester (obtained under the trade designation "INSTRON"; Model 8562 Tester from Instron Corp., Canton, Mass.) fitted with a mechanical alignment fixture (obtained under the trade designation "INSTRON"; Model No. 8000-072 from Instron Corp.) that was driven by a data acquisition system (obtained under the trade designation "INSTRON"; Model No. 8000-074 from Instron Corp.).

Testing was performed using two different gauge lengths; one a 3.8 cm (1.5 inch) and the other a 63 cm (25 inch) gauge length sample fitted with 1018 mild steel tube tabs on the ends of the wire to allow secure gripping by the test apparatus. The actual length of the wire sample was 20 cm (8 inch) longer than the sample gauge length to accommodate installation of the wedge grips. For metal-cladded metal matrix composite wires having a diameter of 2.06 mm (0.081 inch) or less, the tubes were 15 cm (6 inch) long, with an OD (i.e., outside diameter) of 6.35 mm (0.25 inch) and an ID (i.e., inside diameter) of 2.9–3.2 mm (0.11–0.13 inch). The ID and OD should be as concentric as possible. For metal-cladded metal matrix composite wires having a diameter of 3.45 mm (0.14 inch), the tubes were 15 cm (6 inch) long, with an OD (i.e., outside diameter) of 7.9 mm (0.31 inch) and an ID (i.e., inside diameter) of 4.7 mm (0.187 inch). The steel tubes and wire sample were cleaned with alcohol and a 10 cm (4 inch) distance marked from each end of the wire sample to allow proper positioning of the gripper tube to achieve the desired gauge length of 3.8 cm (1.5 inch) or 63 cm (25 inch). The bore of each gripper tube was filled with an epoxy adhesive (available under the trade designation "SCOTCH-WELD 2214 HI-FLEX", a high ductility adhesive, part no. 62-3403-2930-9, from 3M Company) using a sealant gun (obtained under the trade designation "SEMCO", Model 250, obtained from Technical Resin Packaging, Inc., Brooklyn Center, Minn.) equipped with a plastic nozzle (obtained from Technical Resin Packaging, Inc.). Excess epoxy resin was removed from the tubes and the wire inserted into the tube to the mark on the wire. Once the wire was inserted into the gripper tube additional epoxy resin was injected into the tube, while holding the wire in position, to ensure that the tube was full of resin. (The resin was back filled into the tube until epoxy just squeezed out around the wire at the base of the gauge length while the wire was maintained in position). When both gripper tubes were properly positioned on the wire the sample was placed into a tab alignment fixture that maintained the proper concentric alignment of the gripper tubes and wire during the epoxy cure cycle. The assembly was subsequently placed in a curing oven maintained at 150° C. for 90 minutes to cure the epoxy.

The test frame was carefully aligned in the Instron Tester using a mechanical alignment device on the test frame to achieve the desired alignment. During testing only the outer 5 cm (2 inch) of the gripper tubes were gripped by serrated V-notch hydraulic jaws using a machine clamping pressure of approximately 14–17 MPa (2–2.5 ksi).

A strain rate of 0.01 cm/cm (0.01 inch/inch) was used in a position control mode. The strain was monitored using a dynamic strain gauge extensometer (obtained under the trade designation "INSTRON", Model No. 2620-824 from Instron Corp.). The distance between extensometer knife edges was 1.27 cm (0.5 inch) and the gauge was positioned at the center of the gauge length and secured with rubber bands. The wire diameter was determined using either micrometer measurements at three positions along the wire or from measuring the cross-sectional area and calculating the effective diameter to provide the same cross-sectional area. Output from the tensile test provided load to failure, tensile strength, tensile modulus, and strain to failure data for the samples. Ten samples were tested, from which average, standard deviation, and coefficient of variation could be calculated.

Fiber Strength

Fiber strength was measured using a tensile tester (commercially available under the trade designation "INSTRON 4201" from Instron Corp. Canton, Mass.), and the test described in ASTM D 3379-75, (Standard Test Methods for Tensile Strength and Young's Modulus for High Modulus Single-Filament Materials). The specimen gauge length was 25.4 mm (1 inch), and the strain rate was 0.02 mm/mm. To establish the tensile strength of a fiber tow, ten single fiber filaments were randomly chosen from a tow of fibers and each filament was tested to determine its breaking load.

Fiber diameter was measured optically using an attachment to an optical microscope (commercially available under the trade designation "DOLAN-JENNER MEASURE-RITE VIDEO MICROMETER SYSTEM", Model M25-0002, from Dolan-Jenner Industries, Inc. of Lawrence, Mass.) at 1000× magnification. The apparatus used reflected light observation with a calibrated stage micrometer. The breaking stress of each individual filament was calculated as the load per unit area.

Coefficient of Thermal Expansion (CTE)

The CTE was measured following ASTM E-228, published in 1995. The work was performed on a dilatometer (obtained under the trade designation "UNITHERM 1091") using a wire length of (5.1 cm) 2 inch. A fixture was used to hold the sample composed of two cylinders of aluminum with an outer diameter of 10.7 mm (0.42 inch) drilled to an inner diameter of 6.4 mm (0.25 inch. The sample was clamped by a set screw on each side. The sample length was measured from the center of each set screw. At least two calibration runs were performed for each temperature range with a National Institute of Standards and Technology (NIST) certified fused silica calibration reference sample (obtained under the trade designation "Fused Silica" from NIST of Washington, D.C.). Samples were tested over a temperature range from −75° C. to 500° C. with a heating ramp rate of 5° C. in a laboratory air atmosphere. The output from the test was a set of data of dimension expansion vs. temperature that were collected every 50° C. during heating or every 10° C. during cooling. Since CTE is the rate of change of expansion with temperature the data required processing to obtain a value for the CTE. The expansion vs. temperature data was plotted using a graphical software package (obtained under the trade designation "EXCEL" from Microsoft, Redmond, Wash.). A second order power function was fit to the data using the standard fitting functions available in the software to obtain an equation for the curve. The derivative of this equation was calculated, yielding a linear function. This equation represented the rate of change of expansion with temperature. This equation was plotted over the temperature range of interest, e.g., −75–500° C., to give a graphical representation of CTE vs. temperature. The equation was also used to obtain the instantaneous CTE at any temperature.

The CTE is assumed to change according to the equation $\alpha cl=[Ef\alpha fVf+Em\alpha m(1-Vf)]/(EfVf+E_m(1-V_f))$, where: $V_f$=fiber volume fraction, $E_f$=fiber tensile modulus, $E_m$=matrix tensile modulus (in-situ), $\alpha_{cl}$=composite CTE in the longitudinal direction, $\alpha_f$=fiber CTE, and $\alpha_m$=matrix CTE.

Diameter

The diameter of the wire was measured by taking micrometer readings at four points along the wire. Typically the wire was not a perfect circle and so there was a long and short aspect. The readings were taken by rotating the wire to ensure that both the long and short aspects were measured. The diameter was reported as the average of long and short aspect.

Fiber Volume Fraction

The fiber volume fraction was measured by a standard metallographic technique. The wire cross-section was polished and the fiber volume fraction measured by using the density profiling functions with the aid of a computer program called NIH IMAGE (version 1.61), a public domain image-processing program developed by the Research Services Branch of the National Institutes of Health. This software measured the mean gray scale intensity of a representative area of the wire.

A piece of the wire was mounted in mounting resin (obtained under the trade designation "EPOXICURE" from Buehler Inc., Lake Bluff, Ill.) The mounted wire was polished using a conventional grinder/polisher (obtained from Struers, West Lake, Ohio) and conventional diamond slurries with the final polishing step using a 1 micrometer diamond slurry obtained under the trade designation "DIAMOND SPRAY" from Struers) to obtain a polished cross-section of the wire. A scanning electron microscope (SEM) photomicrograph was taken of the polished wire cross-section at 150×. When taking the SEM photomicrographs, the threshold level of the image was adjusted to have all fibers at zero intensity, to create a binary image. The SEM photomicrograph was analyzed with the NIH IMAGE software, and the fiber volume fraction obtained by dividing the mean intensity of the binary image by the maximum intensity. The accuracy of this method for determining the fiber volume fraction was believed to be +/−2%.

Roundness Value

Roundness value, which is a measure of how closely the wire cross-sectional shape approximates a circle, is defined by the mean of the single roundness values over a specified length. Single roundness values for calculating the mean was determined as follows using a rotating laser micrometer (obtained from Zumbach Electronics Corp., Mount Kisco, N.Y. under the trade designation "ODAC 30J ROTATING LASER MICROMETER"; software: "USYS-100", version BARU13A3), set up such that the micrometer recorded the wire diameter every 100 msec during each rotation of 180 degrees. Each sweep of 180 degrees took 10 seconds to accomplish. The micrometer sent a report of the data from each 180 degree rotation to a process database. The report contained the minimum, maximum, and average of the 100 data points collected during the rotation cycle. The wire speed was 1.5 meters/minute (5 feet/minute). A "single roundness value" was the ratio of the minimum diameter to the maximum diameter, for the 100 data points collected during the rotation cycle. The roundness value is then the mean of the measured single roundness values over a specified length. A single average diameter was the average of the 100 data points.

Roundness Uniformity Value

Roundness uniformity value, which is the coefficient of variation in the measured single roundness values over a specified length, is the ratio of the standard deviation of the measured single roundness values divided by the mean of the measured single roundness values. The standard deviation was determined according to the equation:

$$\text{standard deviation} = \sqrt{\frac{n\sum_{i=1}^{n}\chi_i^2 - \left(\sum_{i=1}^{n}\chi_i\right)^2}{n(n-1)}} \quad (1)$$

where n is the number of samples in the population (i.e., for calculating the standard deviation of the measured single roundness values for determining the diameter uniformity value n is the number of measured single roundness values over the specified length), and x is the measured value of the sample population (i.e., for calculating the standard deviation of the measured single roundness values for determining the diameter uniformity value x are the measured single roundness values over the specified length). The measured single roundness values for determining the mean were obtained as described above for the roundness value.

Diameter Uniformity Value

Diameter uniformity value, which is the coefficient of variation in the measured single average diameter over a specified length, is defined by the ratio of the standard deviation of the measured single average diameters divided by the mean of the measured single average diameters. The measured single average diameter is the average of the 100 data points obtained as described above for roundness values. The standard deviation was calculated using Equation (1).

Example 1

An aluminum matrix composite wire was prepared using 34 tows of 1500 denier "NEXTEL 610" alumina ceramic fibers. Each tow contained approximately 420 fibers. The fibers were substantially round in cross-section and had diameters ranging from approximately 11–13 micrometers on average. The average tensile strength of the fibers (measured as described above) ranged from 2.76–3.58 GPa (400–520 ksi). Individual fibers had strengths ranging from 2.06–4.82 GPa (300–700 ksi). The fibers (in the form of multiple tows) were fed through the surface of the melt into a molten bath of aluminum, passed in a horizontal plane under 2 graphite roller, and then back out of the melt at 45 degrees through the surface of the melt, where a die body was positioned, and then onto a take-up spool (e.g. as described in U.S. Pat. No. 6,336,495 (McCullough et al.), FIG. 1). The aluminum (>99.95% Aluminum from Belmont Metals, NY, New York) was melted in an alumina crucible having dimensions of 24.1 cm×31.3 cm×31.8 cm (9.5"×12.5"×12.5") (obtained from Vesuvius McDaniel of Beaver Falls, Pa.). The temperature of the molten aluminum was approximately 720° C. An alloy of 95% niobium and 5% molybdenum (obtained from PMTI Inc. of Large, Pa.) was fashioned into a cylinder having dimensions of 12.7 cm (5 inch) long×2.5 cm (1 inch) diameter. The cylinder was used as an ultrasonic horn actuator by tuning to the desired vibration (i.e., tuned by altering the length), to a vibration frequency of 20.06–20.4 kHz. The amplitude of the actuator was greater than 0.002 cm (0.0008 inch). The tip of the actuator was introduced parallel to the fibers between the rollers, such that the distance between them was <2.54 mm (<0.1 inch). The actuator was connected to a titanium waveguide which, in turn, was connected to the ultrasonic transducer. The fibers were then infiltrated with matrix material to form wires of relatively uniform cross-section and diameter. Wires made by this process had diameters of 2.06 mm (0.081 inch).

The die body positioned at the exit side was made from boron nitride and was inclined at 45 degrees to the melt surface and contained a hole with an internal diameter suitable to introduce an alumina thread-guide, which had an internal diameter of 2 mm (0.08 inch). The thread guide was glued in to place using an alumina paste. Upon exiting from the die, the wire was cooled with nitrogen gas to prevent damage to and burning of rubber drive rollers that pulled the wire and fiber through the process. The wire was then spooled up on flanged wooden spools.

The volume percent of fiber was estimated from a photomicrograph of a cross section (at 200× magnification) to be approximately 45 volume %.

The tensile strength of the wire was 1.03–1.31 GPa (150–190 ksi).

The elongation at room temperature was approximately 0.7–0.8%. Elongation was measured during the tensile test by an extensometer.

The aluminum composite wire (ACW) was supplied as core wire 26 (as in FIGS. 1 and 2) for cladding according to the method of the present invention. It was supplied on a spool 36 inch OD, 30 inch ID, 3 inch wide, and the spool was placed on a pay off system. The tension of ACW 26 was kept minimal, using a breaking system, so that the tension was just sufficient to prevent the spool of aluminum composite wire from uncoiling. ACW 26 to be clad was not surface cleaned and was not pre-heated prior to being threaded through cladding machine 30 and attached to a take-up drum on the exit side.

The cladding machine (Model 350, marketed under the trade designation "CONKLAD" by BWE Ltd, Ashford, England, UK) was run in the tangential mode (see FIG. 2), which indicates the product centerline runs tangential to the extrusion wheel 34. In operation, with reference to FIG. 2, an aluminum feedstock 28 (EC137050; 9.5 mm diameter standard rod, available from Pechiney, France), paid off two pay-off drums (not shown) into the peripheral grooves 42 of rotating extrusion wheel 34, a twin groove standard shaftless wheel. The feedstock aluminum 28 was surface cleaned using a standard parorbital cleaning system, developed at BWE Ltd. to remove surface oxides, films, oils, grease or any form of viscous surface contamination prior to use.

ACW 26 was introduced into cladding machine 30 at inlet die 38 of shoe 32. ACW 26 passed directly through the extrusion tooling (shoe 32) and out exit extrusion die 40 additionally, see FIG. 3). Die chamber 36 was a BWE Type 32 (available from BWE Ltd, in Ashford, England, UK). Two aluminum feed rods entered die chamber 36 on two sides of core wire 26 to equalize the pressure and metal flow. The die chamber 36 was heated to control the aluminum temperature at approximately 500° C. The action of extrusion wheel 36 and heat provided by die chamber 36, filled die chamber 36 with plasticized aluminum 28. Aluminum 28 flowed plastically around ACW 26 and out of exit die 40. Exit die 40 was larger than ACW 26 at 3.45 mm internal diameter to accommodate the cladding thickness.

The extrusion wheel 36 speed was adjusted until aluminum extruded out of the exit die 40 around the ACW 26, and the pressure in the chamber was sufficient to cause some partial bonding between cladding 22 and ACW 26. In addition, extruded aluminum 28 pulled the core wire 26 through exit die 40 such that a take-up drum collecting MCCW 20 product did not apply tension. The line speed of the product exiting the machine was approximately 50 m/min. After exiting the machine, the wire passed through troughs of water to cool it, and then was wound on the take-up drum. A sample of clad ACW was made (304 m (1000 ft) length) with a 0.7 mm clad wall thickness.

The MCCW 20 contains a nominal 2.06 mm (0.081 inch) diameter ACW 26 with aluminum cladding 22 to create MCCW 20 of 3.5 mm (0.140 inch) diameter. The irregular shape of ACW 26 was compensated for in the cladding 22 to create an extremely circular product. The area fraction of MCCW 20 is 33% ACW, 67% aluminum cladding. Given the 45% fiber volume fraction in ACW 26, the MCCW 20 has a net fiber volume fraction of approximately 15%.

Using the wire tensile strength test described above, wire made in Example 1 was tested (3.8 cm (1.5 inch gauge length)):

| MCCW 20 of Example 1 | ACW 26 of Example 1 |
|---|---|
| Load = 5080 ± 53 N<br>(1142 ± 27 lbs)<br>(COV = 2.4%)<br>Strain = 0.87 ± 0.04%<br>Modulus = 97.9 GPa<br>(14.2 ± 1.7 Msi)<br>Strength = 515 MPa<br>(74.7 ± 1.8 ksi)<br>10 tests | Load = 4199 ± 151 N<br>(944 ± 34 lbs)<br>(COV = 3.6%)<br>Strain = 0.75 ± 0.05%<br>Modulus = data<br>not available<br>Strength = 1260 MPa<br>(183 ± 7 ksi)<br>10 tests |

Figure 8:
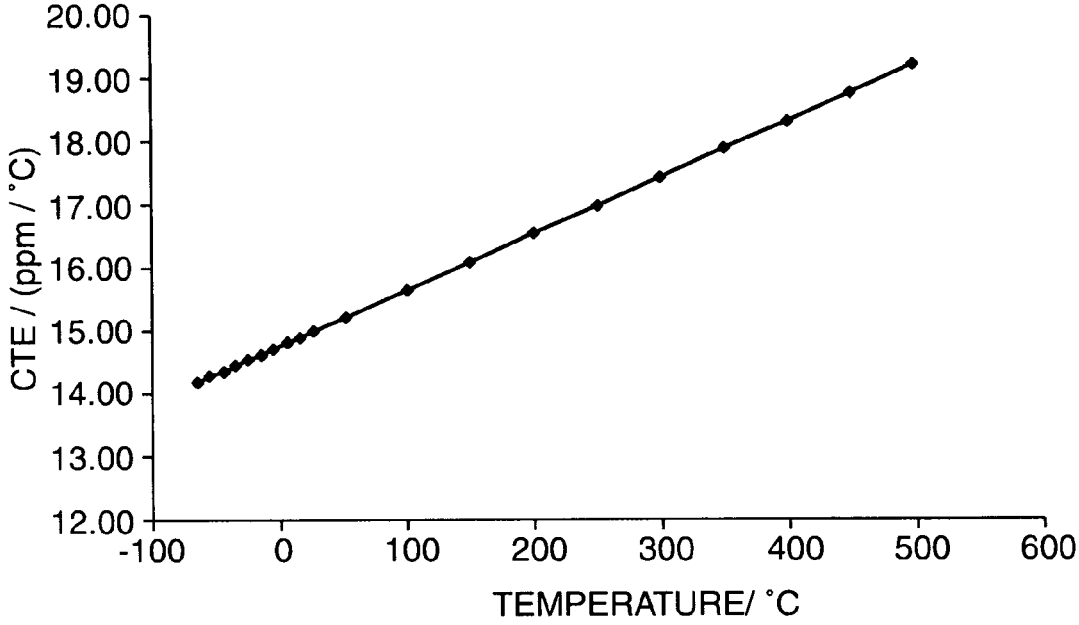
FIG. 8 is a graph of the coefficient of thermal expansion for the metal-cladded metal matrix composite wires produced in Example 1.

MCCW 20 from Example 1, was tested to measure the coefficient of thermal expansion (CTE), along the axis of the wire. The results are illustrated in the graph of CTE versus Temperature of FIG. 8. The CTE ranges from ~14–19 ppm/° C. over the temperature range −75° C. to +500° C.

The MCCW 20 of Example 1 was measured for Wire Roundness, Roundness Uniformity Value, and Diameter Uniformity Value.

Average Diameter=3.57 mm (0.141 inch)
Diameter Uniformity Value=0.12%
Wire Roundness=0.9926
Roundness Uniformity Value=0.29%
Wire Length=130 m (427 ft)

Example 2

Example 2 was prepared as described in Example 1 with the exception that the core wire 26 was heated using induction heating to 300° C. (surface core temperature) prior to inserting in inlet guide die 38. This resulted in a clad wire (MCCW 20) of 304 m (1000 ft) length and 0.70 mm (0.03 inch) cladding wall thickness.

Using the wire tensile Strength test described above, clad wire (MCCW 20) made in Example 2 was tested. (63.5 cm (25 inch gauge length)).

| MCCW 20 of Example 2 | ACW 26 of Example 2 |
|---|---|
| Load = 4888 ± 107 N<br>(1099 ± 24 lbs)<br>(COV = 2.2%)<br>Strain = 0.78 ± 0.03%<br>Modulus = 108 GPa<br>(15.6 ± 1.8 Msi)<br>Strength = 499 MPa<br>(72.4 ± 1.6 ksi)<br>10 tests | Load = 4066 ± 147 N<br>(914 ± 33 lbs)<br>(COV = 3.6%)<br>Strain = 0.66 ± 0.05%<br>Modulus = 223 GPa<br>(32.3 ± 1.5 Msi)<br>Strength = 1220 MPa<br>(177 ± 6 ksi)<br>10 tests |

Figure 9:
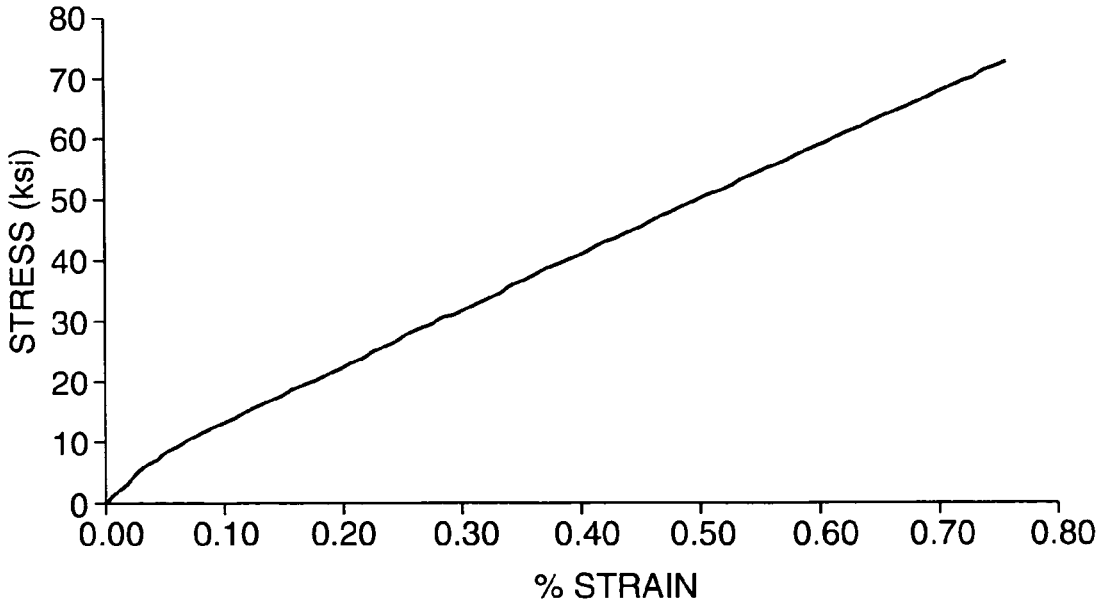
FIG. 9 is a graph of the stress-strain behavior for the metal-cladded metal matrix composite wires produced in Example 2.

Clad wire (MCCW 20) from Example 2, was analyzed to determine the yield strength of the aluminum cladding. A graph of stress-strain behavior for the clad wire of Example 2 is illustrated in FIG. 9. There is a change in slope at in the range of 0.04–0.06% strain, which is associated with the yielding of the aluminum cladding. The core wire itself shows no such yield behavior. FIG. 9 suggests the onset of yielding occurs at 0.042% strain. Thus the yield strength would be modulus multiplied by the yield strain. The tensile modulus of pure aluminum is 69 GPa (10 Msi). Therefore the yield stress calculates to be 29.0 MPa (4.2 ksi).

Comparative Example 1

AMC core wires 26, 2.05 mm (0.081 inch) diameter (prepared as described in Example 1), were tested to failure in tension using the Wire Tensile Strength Test described above. The number of breaks were recorded after the test by visual inspection. Multiple breaks were observed for wires with gage lengths equal or longer than 380 mm (15 inch). The number of breaks typically varied from 2 to 4 for gage lengths up to 635 mm (25 inch). A high speed video camera (marketed under the trade designation "KODAK" by Kodak, Rochester, N.Y. (Kodak HRC 1000, 500 frames/sec; placed 61 cm (2 feet) from sample)) was used to document the failure mechanism. The video shows the sequence of breaks in each wire; primary (the first) failure was tensile in nature, and all subsequent failures (i.e., secondary fractures) showed general compressive buckling as one of the operative mechanisms. Fractography (SEM) of other fracture surfaces also revealed that compressive micro-buckling was another secondary failure mechanism.

Example 3

Figure 10:
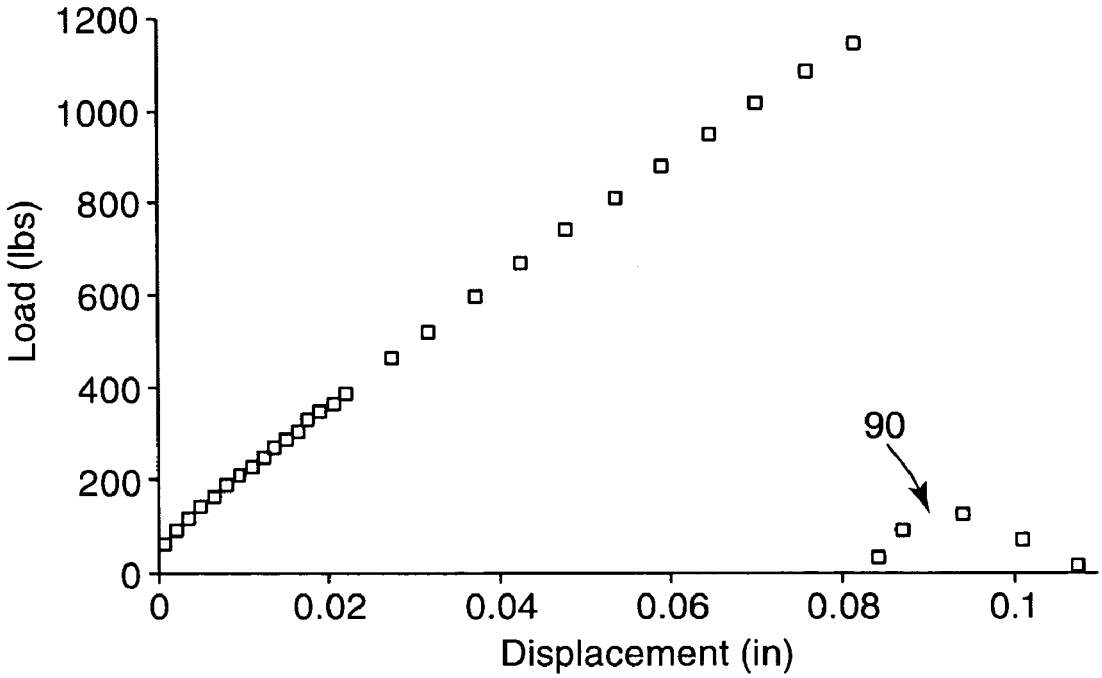
FIG. 10 is a graph illustrating the displacement and recovery for the metal-cladded metal matrix composite wire produced in Example 3.

AMC core wires 26, 2.06 mm (0.081 inch) diameter cladded with a 0.7 mm (0.03 inch) aluminum cladding 22 (as described for Example 1), were tested to failure in tension. The clad wire (MCCW 20) had a 635 mm (25 inch) gage length. The clad wire did not exhibit secondary fractures after primary failure in tension (the load to failure was on average 4900 N). The absence of secondary fractures was verified by re-gripping the longer section of broken wires (MCCW 20) and re-testing them in tension (the gage length was still greater than 38.1 cm (15 inch). Upon re-testing, the clad wires (MCCW 20) exhibited a slightly greater load to failure (~5000N). This result indicated that there were no hidden secondary fracture sites in the clad wire. The load-displacement also clearly indicated the role of the aluminum cladding 22 when the primary tensile failures occur, as shown in the graph of FIG. 10. The sudden drop in load is associated with the primary failure on the ACW 26, however, the load does not drop to zero immediately; some of the load is carried by the aluminum cladding 22 which stretches and dampens the sudden recoil as illustrated by the area of the graph at arrow 90.

Bending Retention Test

The bending retention test illustrates the amount of bend retained by a wire after deformation. If no bend is retained, the wire is fully elastic. If some amount of bend is retained, the wire or at least a portion of the wire has plastically deformed so as to retain a bent shape. The Bending Retention Test is typically performed at bend angles and forces below the failure strength of the wire that is tested.

Figure 11:
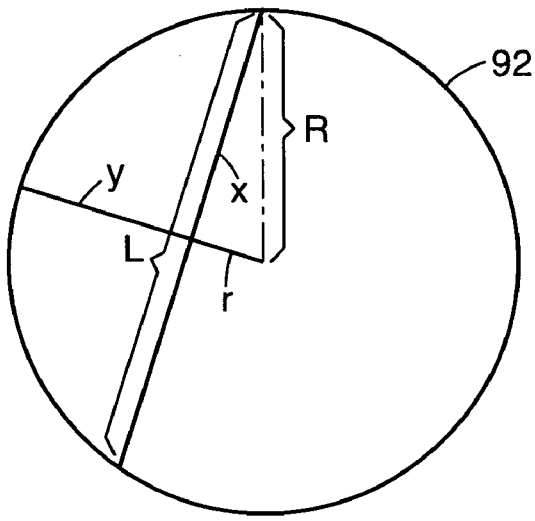
FIG. 11 is a schematic view of the geometric construction used in the Bend Retention Test.

A length of MCCW 20 (as described above) is coiled, by hand, into a circular loop to form a coiled sample 92 as illustrated in the diagram of FIG. 11. The coiled sample 92 is a closed circle of specific diameter ranging from approximately 20.3 cm (8 inch) to 134.6 cm (53 inch) in circumference.

For each coiled sample 92, the length of a chord L of the coiled sample 100 was measured. A length of a line segment y that is perpendicular to the chord L and goes from the midpoint of the chord L to the edge of coiled sample 92 was measured. The initial bend radius, $R_{initial}$, was calculated for each sample according to Equation 2, where x=½ L.

$$\frac{y^2 + x^2}{2y} = R \tag{2}$$

The values of L, y and $R_{initial}$ for Examples 4–3 are given in Table 1, below.

TABLE 1

| Example | L cm (inches) | y cm (inches) | $R_{initial}$ cm (inches) |
|---|---|---|---|
| 4 | 91.29 (35.94) | 42.62 (16.78) | 45.75 (18.01) |
| 5 | 78.11 (30.75) | 52.07 (20.50) | 40.69 (16.02) |
| 6 | 29.85 (11.75) | 4.67 (1.84) | 26.16 (10.30) |
| 7 | 114.63 (45.13) | 32.39 (12.75) | 66.90 (26.34) |
| 8 | 18.77 (7.39) | 3.96 (1.56) | 13.11 (5.16) |
| 9 | 44.58 (17.55) | 12.29 (4.84) | 26.34 (10.37) |
| 10 | 69.85 (27.50) | 31.75 (12.50) | 35.08 (13.81) |
| 11 | 13.03 (5.13) | 2.46 (0.97) | 9.86 (3.88) |
| 12 | 42.14 (16.59) | 12.55 (4.94) | 23.95 (9.43) |
| 13 | 28.91 (11.38) | 11.40 (4.49) | 14.86 (5.85) |

The ends of coiled sample 92 were then released and the clad wire (MCCW 20) was allowed to relax to a final curved form. The dimensions Y' and L' were measured on this relaxed wire and the final bend radius $R_{final}$ was calculated. The results for various examples are presented in Table 2 below.

TABLE 2

| Example | L' cm (inches) | Y' cm (inches) | $R_{final}$ cm (inches) |
|---|---|---|---|
| 4 | 124.46 (49.00) | 26.19 (10.31) | 87.04 (34.27) |
| 5 | 126.52 (49.81) | 23.98 (9.44) | 95.43 (37.57) |
| 6 | 88.27 (34.75) | 23.29 (9.17) | 53.47 (21.05) |
| 7 | 116.21 (45.75) | 31.70 (12.48) | 69.09 (27.20) |
| 8 | 48.90 (19.25) | 10.01 (3.94) | 32.33 (12.73) |
| 9 | 85.73 (33.75) | 25.10 (9.88) | 49.15 (19.35) |
| 10 | 93.98 (37.00) | 19.05 (7.50) | 67.49 (26.57) |
| 11 | 47.96 (18.88) | 10.80 (4.25) | 32.03 (12.61) |
| 12 | 49.53 (19.50) | 9.22 (3.63) | 37.87 (14.91) |
| 13 | 48.67 (19.16) | 10.01 (3.94) | 34.59 (13.62) |

Figure 12:
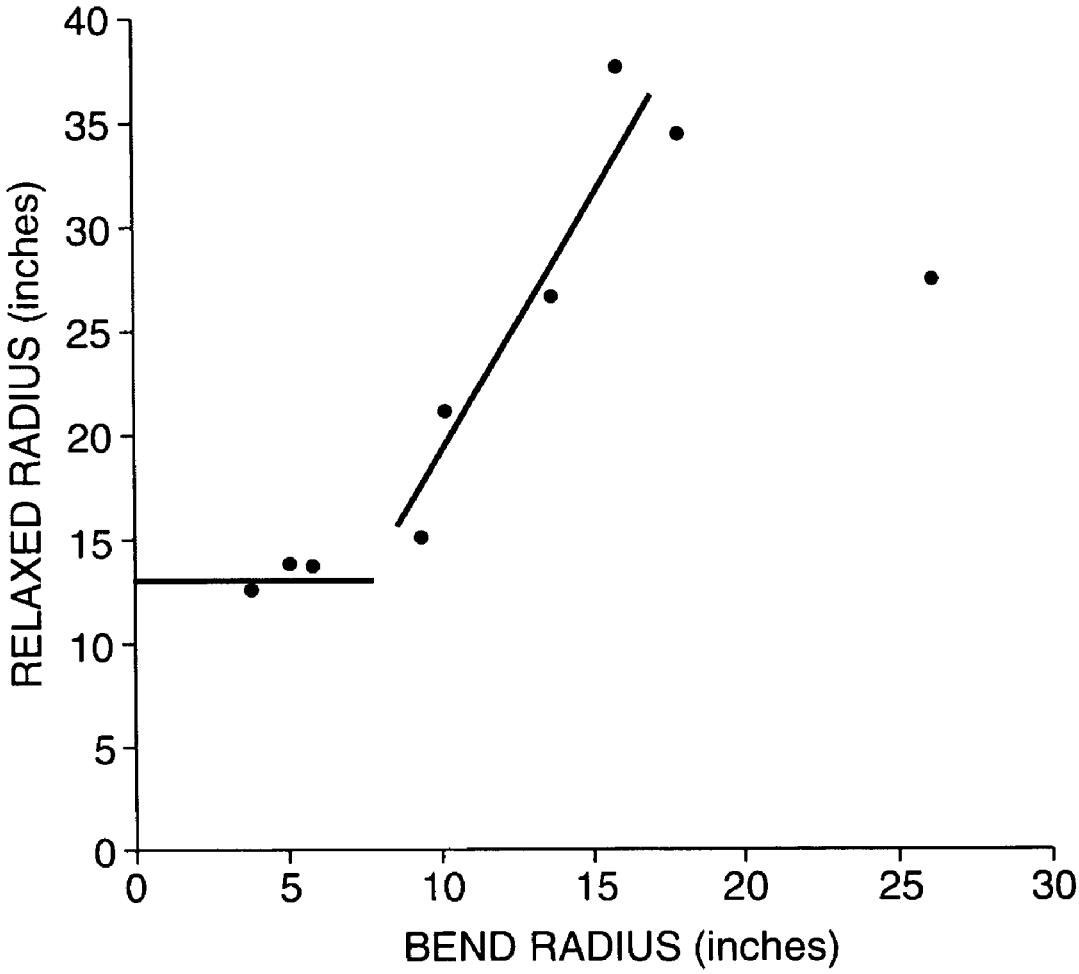
FIG. 12 is an exemplary graph of relaxed radius versus bend radius that illustrates plastic deformation of metal-cladded metal matrix composite wires made in accordance with the present invention.

The relaxed radius versus the bend radius is plotted in FIG. 12.

Two theoretical models, the Inner Radius Model and the Plastic Hinge Model, were used to predict the thickness of the cladding required for a MCCW to hold a set of 13.0 inches (33.0 cm). The following calculations determine the necessary thickness t of cladding around a core wire with radius r that is necessary to maintain a final relaxed bending radius of ρ for MCCW. The models differ in how the ductile metal in the cladding fields.

The bending moment of the center core wire is:

$$M_{bw} = \frac{EI_{zzw}}{\rho} \tag{3}$$

The moment of area $I_{zzw}$ for a solid circular cross-section is:

$$I_{zzw} = \frac{\pi r^4}{4} \tag{4}$$

where r is the radius of the core wire, E is the elastic modulus of the core wire and ρ is the bend radius of the MCCW.

The Inner Radius Model predicts that an equilibrium state of the wire occurs when the stress in the cladding material at the inner edge of the cladding equals the yield strength of the clad material. That is $\sigma_x$=Y where $\sigma_x$ is the stress in the clad material and Y is the yield strength of the clad material.

The bending moment $M_L$ of the wire in this state is:

$$M_L = -\frac{\sigma_x I_{zzc}}{r} \tag{5}$$

The moment of area the circular ring $I_{zzC}$ of the cladding is defined as:

$$I_{zzC} = \frac{\pi((r+t)^4 - r^4)}{4} \tag{6}$$

A second model, the Plastic Hinge Model, uses the following equations:

The bending moment $M_P$ at equilibrium is defined as:

$$M_P = \frac{\sigma_x I_{zzP}}{(r+t)} \tag{7}$$

The Moment of Area $I_{zzP}$ for the Plastic Hinge Model is:

$$I_{zzP} = \frac{\pi((r+t)^4 - r^4)}{2} \tag{8}$$

The relaxed final state of the wire is determined as the point where the bending moment of the core wire equals the bending yield moment of the MCCW.

For the Inner Radius Model this occurs at:

$$M_{bw}=M_L \tag{9}$$

For the Plastic Hinge Model this occurs at:

$$M_{bw}=M_P \tag{10}$$

Equations 7 and 8 can be solved for the cladding thickness t as a function of the radius of the core wire, r, cladding material yield strength Y, bend radius of MCCW, and elastic modulus of the core wire.

The following parameters are used for the following example:

core wire radius r=0.040 inch core wire elastic modulus E=24 MSI

MCCW bend radius ρ=13 inch cladding yield stress $\sigma_x$=9,000 ksi

These are solved for the cladding thickness given the measured bend radius of the wire (13.0 inches, 33.0 cm) and an assumed yield strength of the cladding material (9 ksi) (62 MPa).

| Cladding Thickness | inch (cm) |
|---|---|
| Calculated (Inner Radius Model) | 0.030 (0.076) |
| Calculated (Plastic Hinge Model) | 0.027 (0.069) |
| Measured | 0.030 (0.076) |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of making a metal-cladded metal matrix composite wire, the method comprising:

moving a metal matrix composite wire through a chamber, the metal matrix composite wire having an exterior surface, the metal matrix composite wire comprising:

at least one tow, wherein the tow comprises a plurality of substantially continuous fibers that are oriented longitudinally with respect to each other, the fibers comprising at least one of ceramic or carbon; and a metal matrix, wherein each tow is positioned within the metal matrix;

associating ductile metal with the exterior surface of the metal matrix composite wire within the chamber while the temperature in the chamber is held below the melting point of the ductile metal and the pressure in the chamber is sufficient to plasticize the ductile metal; and withdrawing the metal matrix composite wire with the associated ductile metal from the chamber under conditions that are effective to shape the associated ductile metal into a metal cladding that covers the exterior surface of the metal matrix composite wire to provide the metal-cladded metal matrix composite wire.

2. The method of claim 1, wherein the ductile metal has a melting point of not greater than 1000° C.

3. The method of claim 1, wherein the ductile metal has a melting point of not greater than 700° C.

4. The method of claim 1, wherein the metal of the metal matrix composite comprises at least one of aluminum, zinc, tin, magnesium, copper, or alloys thereof.

5. The method of claim 1, wherein the metal of the metal matrix composite comprises at least one of aluminum or alloys thereof.

6. The method of claim 1, wherein the metal matrix composite wire comprises in a range from 40 to 70 percent by volume fiber, based on the total volume of the metal matrix composite wire.

7. The method of claim 1, wherein at least 85% by number of the fibers are substantially continuous.

8. The method of claim 1, wherein the fibers are ceramic oxide fibers.

9. The method of claim 1, wherein the fibers are polycrystalline, alpha alumina-based fibers.

10. The method of claim 9, wherein the polycrystalline, alpha alumina-based fibers comprise at least 99% by weight $Al_2O_3$, based on the total metal oxide content of the respective fiber.

11. The method of claim 1, wherein the ductile metal is selected from the group consisting of: aluminum, zinc, tin, magnesium, copper, and alloys thereof.

12. The method of claim 1, wherein the ductile metal is aluminum.

13. The method of claim 1, wherein the associated ductile metal is shaped such that the wire is concentrically surrounded by the ductile metal.

14. The method of claim 13, wherein the ductile metal covers the metal matrix composite wire to a thickness in a range from 0.2 mm to 6 mm.

15. The method of claim 13, wherein the ductile metal covers the metal matrix composite wire to a thickness in a range from 0.5 mm to 3 mm.

16. The method of claim 1, wherein the metal-cladded metal matrix composite wire has a roundness value of at least 0.95 over a length of at least 100 meters.

17. The method of claim 1, wherein the metal-cladded metal matrix composite wire has a roundness uniformity value not greater than 0.5% over a length of at least 100 meters.

18. The method of claim 1, wherein the metal-cladded metal matrix composite wire has a diameter uniformity value not greater than 0.3% over a length of at least 100 meters.

19. The method of claim 1 wherein moving a metal matrix composite wire through a chamber follows a straight-line path from a chamber entry die to a chamber exit die.

20. A method of making a metal-cladded metal matrix composite wire, the method comprising:

providing a metal matrix composite wire having an exterior surface, the metal matrix composite wire comprising:

at least one tow, wherein the tow comprises a plurality of substantially continuous fibers that are oriented longitudinally with respect to each other, the fibers comprising at least one of ceramic or carbon; and a metal matrix, wherein each tow is positioned within the metal matrix;

associating ductile metal with the exterior surface of the metal matrix composite wire; and manipulating the associated ductile metal under conditions that are effective to shape the associated ductile metal into metal cladding covering the exterior surface of the metal matrix composite wire to provide the metal-cladded metal matrix composite wire, wherein the metal matrix composite wire, when provided in a 300 meter long segment, exhibits a roundness value of at least 0.95.

21. The method of claim 20, wherein the ductile metal has a melting point of not greater than 1000° C.

22. The method of claim 20, wherein the ductile metal has a melting point of not greater than 700° C.

23. The method of claim 20, wherein the metal matrix composite comprises at least one of aluminum, zinc, tin, magnesium, copper, or alloys thereof.

24. The method of claim 20, wherein the metal matrix composite comprises at least one of aluminum or alloys thereof.

25. The method of claim 20, wherein the metal matrix composite wire comprises in a range from 40 to 70 percent by volume fiber, based on the total volume of the wire.

26. The method of claim 20, wherein at least about 85% by number of the fibers are substantially continuous.

27. The method of claim 20, wherein the fibers are ceramic oxide fibers.

28. The method of claim 20, wherein the fibers are polycrystalline, alpha alumina-based fibers.

29. The method of claim 28, wherein the polycrystalline, alpha alumina-based fibers comprise at least 99% by weight $Al_2O_3$, based on the total metal oxide content of the respective fiber.

30. The method of claim 20, wherein the ductile metal is selected from the group consisting of: aluminum, zinc, tin, magnesium, copper, and alloys thereof.

31. The method of claim 20, wherein the ductile metal is aluminum.

32. The method of claim 20, wherein the associated ductile metal is shaped such that the wire is concentrically surrounded by the ductile metal.

33. The method of claim 32, wherein the ductile metal covers the metal matrix composite wire to a thickness in a range from 0.2 mm to 6 mm.

34. The method of claim 32, wherein the ductile metal covers the metal matrix composite wire to a thickness in a range from 0.5 mm to 3.0 mm.

35. The method of claim 30, wherein the metal-cladded metal matrix composite wire has a length of at least 100 meters and exhibits plastic deformation.

36. The method of claim 20, wherein the metal-cladded metal matrix composite wire has a diameter uniformity value is not greater than 0.5% over a length of at least 100 meters.

37. The method of claim 20, wherein the metal-cladded metal matrix composite wire has a diameter uniformity value is not greater than 0.3% over a length of at least 100 meters.

38. The method of claim 20, wherein the ductile metal is placed in association with the exterior surface of the wire by heating the ductile metal to a temperature below the melting temperature of the ductile metal.

39. The method of claim 38, wherein pressure applied to the ductile metal whereby the ductile metal plastically coats the exterior surface of the wire.

* * * * *